United States Patent [19]

Winter et al.

[11] Patent Number: 5,024,177

[45] Date of Patent: Jun. 18, 1991

[54] WIND SAILING SURF VESSEL WITH DUAL PLANAR SURFACES

[76] Inventors: Steven D. Winter, 47 Ilex Dr., Newbury Park, Calif. 91320; Michael J. Botich, 1307 Hanover Ct., Ventura, Calif. 93003; Eric Adickes, 315 Anacapa View Dr., Malibu, Calif. 90265

[21] Appl. No.: 328,163

[22] Filed: Apr. 26, 1989

[51] Int. Cl.[5] ..... B63B 1/00

[52] U.S. Cl. ..... 114/61; 114/39.2

[58] Field of Search ..... 114/39.1, 39.2, 61, 114/90, 91, 123

[56] References Cited

U.S. PATENT DOCUMENTS 4,401,047 8/1983 Auras ..... 114/39.1

FOREIGN PATENT DOCUMENTS 3326112 1/1985 Fed. Rep. of Germany ..... 114/39.2
3341996 5/1985 Fed. Rep. of Germany ..... 114/61
2510509 2/1983 France ..... 114/39.2

*Primary Examiner*—Joseph F. Peters, Jr.
*Assistant Examiner*—Jesus D. Sotelo
*Attorney, Agent, or Firm*—Cislo & Thomas

[57] ABSTRACT

A stable and versatile wind sailing vessel for sailing over a water surface comprising first and second elongated and buoyant boards, each having a planar undersurface. An arching platform disengagably engages the boards in a spaced, side-by-side relationship and a centerboard centrally located on the platform between the boards, provides maneuverability. A windsurfing sail is pivotally mounted on the platform for propelling the vessel. The platform can be disengaged from the boards, allowing each of the boards to be sailed separately as a typical windsurfing vessel. The platform is modular and can be dissociated for compactness. Adjustable legs on the platform allow different degrees of inclination of the planar surfaces with the water surface for varying degrees of control. A mast stay device can be used to releasably keep the sail in an erect position despite blowing wind.

13 Claims, 5 Drawing Sheets

WIND SAILING SURF VESSEL WITH DUAL PLANAR SURFACES

BACKGROUND OF THE INVENTION

This invention relates generally to sailing vessels, more particularly to wind surfing types of sailing vessels, particularly suitable for sailing over large bodies of water.

Popularity of windsurfing-type vessels have grown immensely popular in recent years. The typical windsurfing-type sailing vessel is a relatively portable sailing device which can be taken to various locations for sailing. Furthermore, vessels such as these allow speedy sailing as well as riding any encountered surf. However, a high degree of balance and agility is required with many windsurfing-type vessels or windsurfers. Also, steering and turning is extremely difficult to the novice.

The operator of a conventional windsurfer must balance upon a windsurfing board while holding and directing a fairly large sized sail so as to propel the vessel, as well as, steer the vessel. A great degree of muscle coordination and balance must be developed by practicing extensively until adequate skills are developed to enjoy all the benefits of windsurfing. Often times, many prospective windsurfing enthusiasts unsuccessfully attempt to master the muscle coordination and balance and become disillusioned with the sport. They eventually forego the joys of windsurfing because the commitment of time to develop those skills is far too great. This is especially true for the very young or older person who has neither the time nor the coordination to properly sail a conventional windsurfing vessel.

A number of devices have been developed over the years in an attempt to lessen the balance and coordination requirements for sailing a small wind propelled surfing vessel.

U.S. Pat. No. 2,577,917 issued on Dec. 11, 1951 to H. L. Root discloses a vessel having a pair of pontoons that receive the feet of a user to permit the user to walk or float on the surface of water. A sail can be held to propel the pontoons. A frame member can be operatively associated between the pontoons for seating.

U.S. Pat. No. 3,455,261 issued to H. Perrin on July 15, 1969 discloses a board having a concave undersurface with projecting lateral legs which extend into the water. The sail is used to provide wind propulsion.

U.S. Pat. No. 3,742,886 to J. N. Dillon issued on July 3, 1973 discloses a pontooned water craft comprising of two pontoons which are connected together by a parallelogram linkage. The operator of the craft stands upon the linkage carrying a hand sail and steers the craft with a movable rudder affixed to the linkage.

U.S. Pat. No. 4,159,689 issued to G. Odoj on July 3, 1979 discloses a single board-like floating body to be used with a connecting sail. A rigid plate is affixed to the board which projects into the water.

U.S. Pat. No. 4,437,424 issued to D. W. Lord on Mar. 20, 1984 discloses a wind propelled boat of the sail board type having two pontoons which cut into the water and are connected by a rigid arched member which retains a movable centerboard.

U.S. Pat. No. 4,530,299 issued to A. Ross on July 23, 1985 discloses a wind propelled surfboard which has a catamaran hull wherein each hull can be folded to a collapsed position. Each hull is very narrow for portability and a centerboard is not incorporated.

U.S. Pat. No. 4,537,145 issued to C. R. White on Aug. 27, 1985 discloses an elongated main hull and a shorter elongated float. Both are secured in a parallel relationship with cross beams. A centerboard is not incorporated and a sail is used which is movably affixed to main hull.

U.S. Pat. No. 4,715,306 issued to A. W. Horais on December 1987 discloses a catamaran with a steerable centerboard apparatus wherein the centerboard is pivotally mounted. The catamaran constructed of a pair of parallel hulls are held in parallel fashion by a deck portion.

Each of the references above attempt to provide a personal sailing vessel which allows for speed, steerability and stability. However, the versatility of each of the disclosed references does not allow for the same exalted speed and maneuverability of a conventional single board windsurfing device. Furthermore, the twin pontoons or hulls of the disclosed vessels provide for difficulty in maneuvering, particularly, turning. Like most catamaran type vessels, turning is difficult because two parallel hulls are cutting the water simultaneously. The hull on the side opposite the side of the turn tries to continue on a straight course—slowing the turn. A great degree of stress between the two hulls is transferred to the interconnecting deck. The fluid dynamics around each hull prevent quick turns. Quick turns are only possible when the craft is keeling hard to one side or the other, lifting one hull out of the water. However, this is a very unstable condition.

It is extremely desirable that a windsurfing-type vessel has the stability and the ease of sailing of some of the above-described vessels, yet have the same maneuverability and speed as a conventional single board windsurfing-type device. Also, it is desirable to have such a device having the versatility to be used as a conventional windsurfing device with a minimum amount of disassemble. Portability is also important.

The features identified above as being desirable for a wind sailing vessel are all provided by the present invention.

SUMMARY OF THE INVENTION

The present invention is embodied in an improved wind sailing vessel for sailing over a water surface comprising a first elongated board defining an undersurface substantially planar. A second elongated board defining an undersurface substantially planar is joined to the first elongated board in a spaced side-by-side relationship in an assembled condition. The elongated boards are buoyant in water and are joined together by an upraised platform that arches between both the elongated boards providing a place for a sailor or sailors to stand. A centerboard or keel is used for providing sailing maneuverability operatively associated with the platform means. The centerboard is parallel to the elongated boards and provides substantial steerability, allowing the planar undersurfaces of the elongated boards to skim over the water surface and pivot about the keel, and thus easily turn the vessel.

A windsurfing-type sail is used for catching gusts of wind to propel the vessel. The sail is pivotally mounted on the platform and can be centrally located thereupon.

The platform means is dissociable from the elongated boards and each of the elongated boards can be outfitted so as to independently sail similar to a conventional windsurfing-type vessel.

In one embodiment, the platform means defines a slot parallel to the elongated boards in an assembled condition. The slot is sized to receive the centerboard, wherein the keel is insertable through the slot and retained therein during sailing. The platform means can be modularly made so as to comprise a number of independent sections which can dissociate from each other to collapse the platform for transportation or storage. Furthermore, the platform can be fastened to the elongated boards using a fastening device which is easily releasable so as to allow quick dissociation of the platform from the elongated boards.

Also, the platform can be fastened at various points along the width of the elongated boards which may have a curved contact surface. By fastening the platform to different points along the elongated board, a planing or angled configuration can be obtained for greater performance of the sailing vessel.

The sail comprises a grippable boom for holding and orienting the sail. The sail can be of a larger size than most conventional windsurfing vessels since greater stability is attained with the improved design of the vessel. Also, the vessel may include a mast stay fastening means to assist the sailor in retaining the sail in a particular erected position during sailing.

The elongated boards can additionally include rear fins for providing directional stabilization, wherein the fins are located on the undersurfaces of the elongated boards at the stern end of each of the elongated boards.

The planar undersurfaces of the elongated boards are at least one foot in width in the preferred embodiment and are curved upwardly along a bow end of the elongated boards.

Adjustable legs projecting from an undersurface of the platform may allow association of the platform to the elongated boards, wherein the legs can be adjusted to provide a greater height or inclination between the platform and the elongated boards. This adjustability allows for greater performance of the sailing vessel under varying wind and surf conditions.

The sailing vessel of the present invention provides for a greatly stabilized windsurfing-type craft allowing for greater ease and turning ability, yet requires little balance, coordination and muscular agility. Furthermore, the sailing vessel of the present invention is completely versatile for sailing in an assembled condition or dissociated and used as a conventional windsurfing craft. The vessel is compact and completely portable for purposes of transportation and storage. The sailing vessel is easy to assemble, as well as, disassemble and easy to manufacture.

The sailing vessel described herein allows even the most inexperienced novice in windsurfing to thoroughly enjoy all of the advantages that trained and well-practiced windsurfing sailors have enjoyed heretofore.

Other aspects and advantages of the present invention will become apparent from the following description of the preferred embodiment, taken in conjunction with accompanying drawings, which illustrate, by way of example, the principles of the invention.

DESCRIPTION OF THE PREFERRED EMBODIMENT

Figure 1:
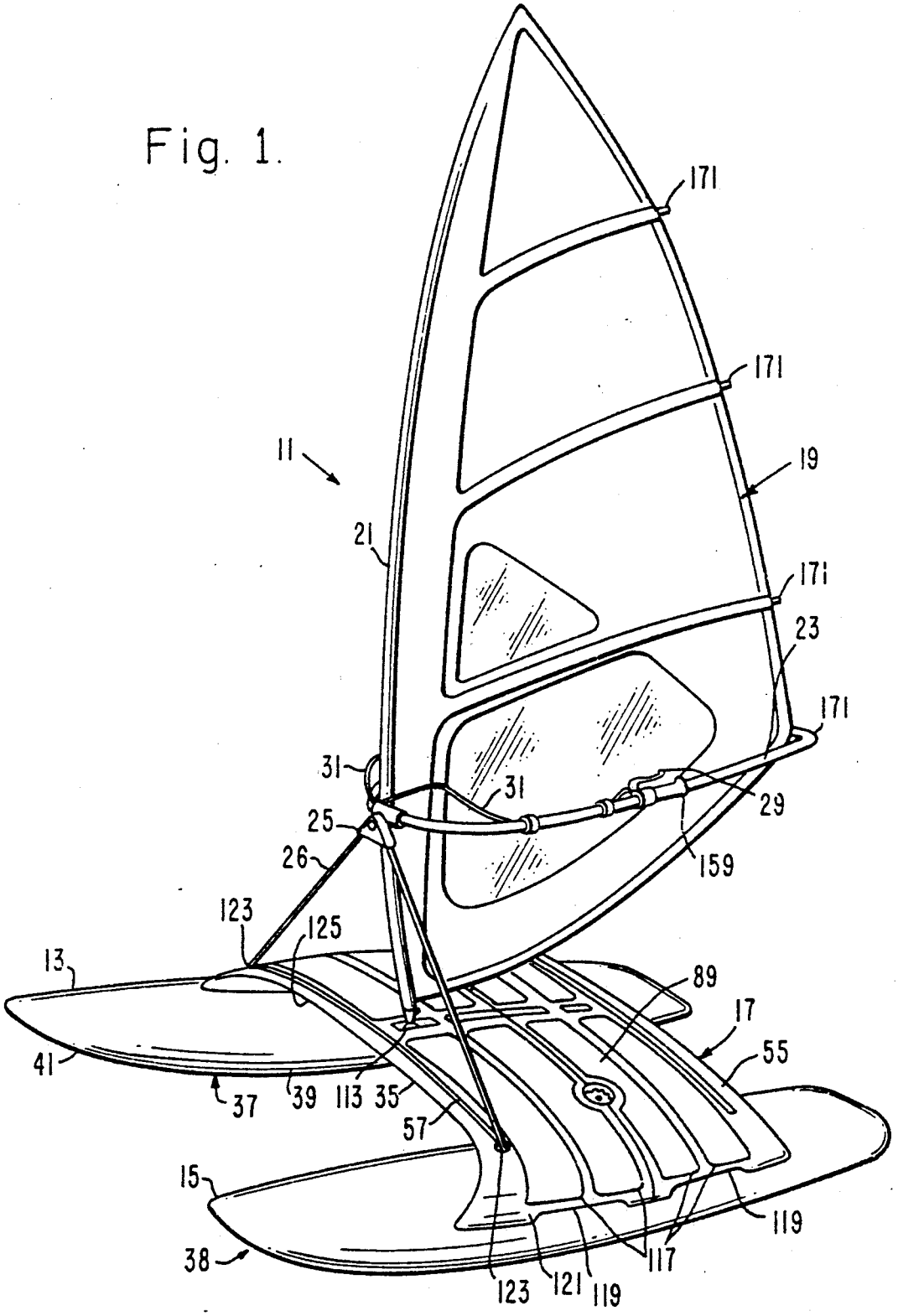
FIG. 1 is a front top right perspective view of the sailing vessel of the present invention in a fully assembled condition.

As shown in the drawings, wherein like numerals represent like elements, FIG. 1 shows the invention embodied in a wind sailing vessel 11 comprising a first board 13 and a second board 15 disengagably held in side-by-side relationship. The first and second boards 13 and 15 are disengageably retained in that relationship by a rigid platform 17 which is arched between the first board 13 and the second board 15. The boards 13 and 15 have planar undersurfaces 37 and 38, respectively.

The preferred embodiment of the invention, includes a sail 19 having a mast 21, and a boom 23 connected thereto for directing the mast 21 and sail 19. The boom 23 allows the manipulation of the mast 21 and sail 19 and also keeps the sail 19 in an unfurled condition.

Furthermore, a mast retaining means 25 holds the mast 21, boom 23 and sail 19 in a desired condition. The mast retaining means 25 includes a cable 26 associated with the platform 17 so as to retain the sail 19 in a desirable position. The mast retaining device 25 can be adjustably actuated by release levers 29 clampedly held to the boom 23 and having cables 31 which actuate the mast retaining means 25 so as to freely slide by or selectively hold the cable 26 in conjunction with the platform 17.

Figure 2:
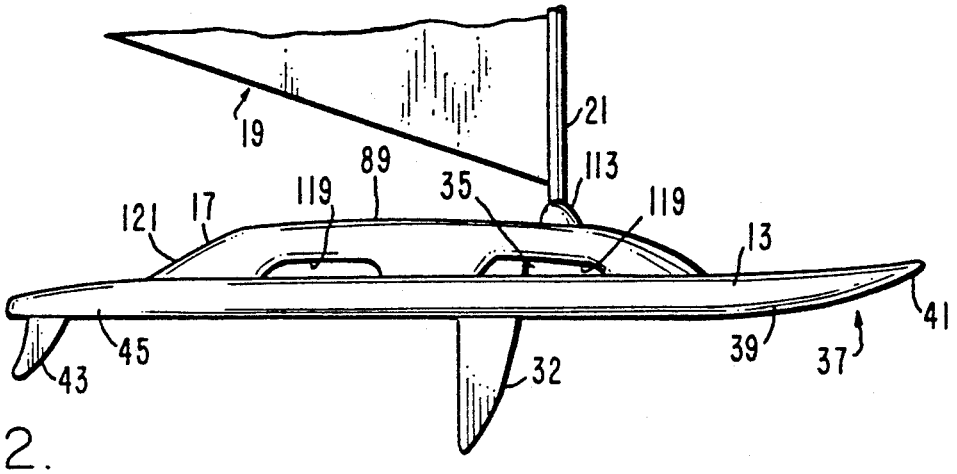
FIG. 2 is a left side elevational view of the sailing vessel of the present invention with the sail partially shown.

Most importantly, as shown in FIG. 2, is a daggerboard, keel or centerboard 32 which projects downwardly from an undersurface 35 of the platform 17 and is in parallel relationship to the first board 13 and the second board 15, being retained therebetween. The centerboard 32 is perpendicular to the undersurfaces 37 and 38 of the boards 13 and 15, respectively, and serves as a stabilizing keel means. The centerboard 32 has a length and geometric shape so as to extend below a plane defined by the first board 13 and the second board 15. Thus, the centerboard 32 is normally extended below the surface of the water (not shown) which is to be sailed upon.

FIGS. 1, 2, 3 and 5, more particularly provide a full or almost full view of the vessel 11 of the present invention.

In greater detail, the first board's planar undersurface 37 has a width of approximately 1½ to 2½ feet. Edges 39 of the undersurface 37 curl upwardly for more improved fluid flow between the first board 13 and the water to be sailed upon. The curvature of the edges 39 is described as having a radius of arc of between 15° and 45° from a plane defined by the undersurface 37 of the first board 13 and a plane tangential at a midpoint of the board's height to the curve edges 39 of the undersurface 37 of the first board 13. The first board 13 may, of course, be symmetrically curved, however the curvature of the edges 39 near the undersurface 37 is not critical to overall performance.

The length of the first board 13 is approximately five to seven feet in the preferred embodiment. Therefore, the undersurface 37 of the first board 13 is of a similar, if not an identical, length. The undersurface 37 curves longitudinally upwardly at a bow end 41 of the first board 13. The undersurface 37 at the bow end 41 of the first board 13 curves gradually upwardly at an angle of approximately 15° to 35° from a plane defined by the undersurface 37 of the first board 13.

A keel or fin 43 is attached and located on the undersurface 37 of the first board 13 at an aft end 45 of the first board 13. The fin 43 provides for greater directional stability when sailing the vessel 11 over the surface of the water.

Figure 3:
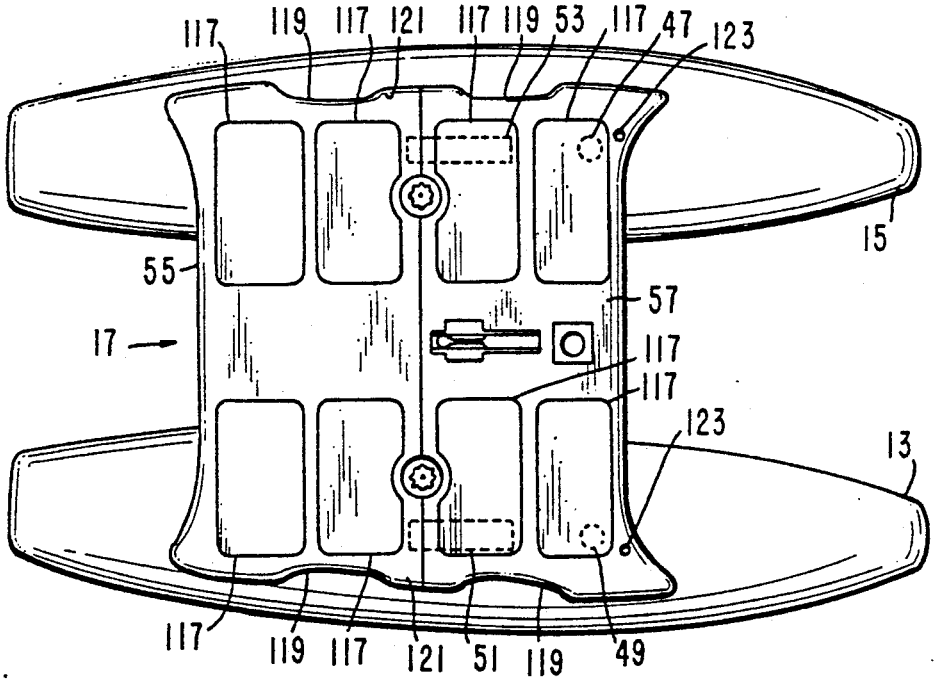
FIG. 3 is a top plan view of the sailing vessel of the present invention without the sail and mast stay means, with typical wind surfing fittings on each of the boards shown in phantom lines.
Figure 5:
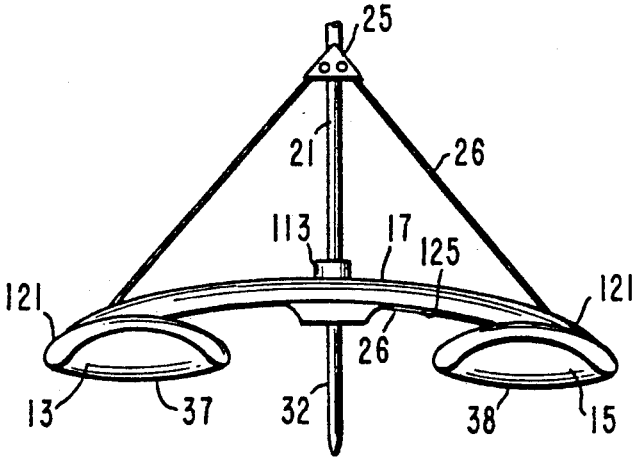
FIG. 5 is a front elevational view of the sailing vessel of the present invention.

The second board 15 and its undersurface 38 is identical or very similar to the first board 13. However, slight variations between the boards 13 and 15 might be tolerated and should not affect the performance of the vessel 11 substantially. It is important that the planar undersurfaces 37 and 38 of both boards 13 and 15, respectively, are sufficient to provide a surfing action when encountering waves and rough water. Particularly, the curved bow end 41 of the boards 13 and 15 allow the vessel 11 to smoothly sail over rough water. As shown in FIG. 3 in phantom lines, both boards 13 and 15 have fittings or receptacles 47 and 49, respectively, for receiving and securing windsurfing sails (not shown) commonly used in the sport of windsurfing. Both boards 13 and 15 also have slots 51 and 53 defined therethrough for purposes of receiving a centerboard (not shown) also typically used in the sport of windsurfing.

In the preferred embodiment, the platform 17 can be removed from the first board 13 and second board 15 so as to allow the independent sailing of the first board 13 and second board 15. The centerboard 32 of the vessel 11 may be of a type so as to be positionable and securely held within either the slot 51 or slot 53 to allow sailing an individual board. Also, the slots 51 and 53 can serve as a means to secure the platform 17. The platform 17 can be designed to engage the slots 51 and 53, and thereby securely retain the boards 13 and 15 together.

The boards 13 and 15 are constructed of a buoyant material, preferably a fiberglas shell with a buoyant foam within as commonly used in the art of surfboard and windsurfing board manufacture. The type of material and construction methods are commonly known in the art of surfboard and windsurfing board manufacture. Furthermore, the boards may be decorated or painted pursuant to the likes of its owner. The boards should have a mean thickness of approximately three to five inches depending upon certain performance criteria. With a thicker cross section of buoyant material within the boards 13 and 15, persons of heavier weight or more than one person can sail the vessel 11 without submerging the boards 13 and 15, which can make getting started difficult.

Figure 4:
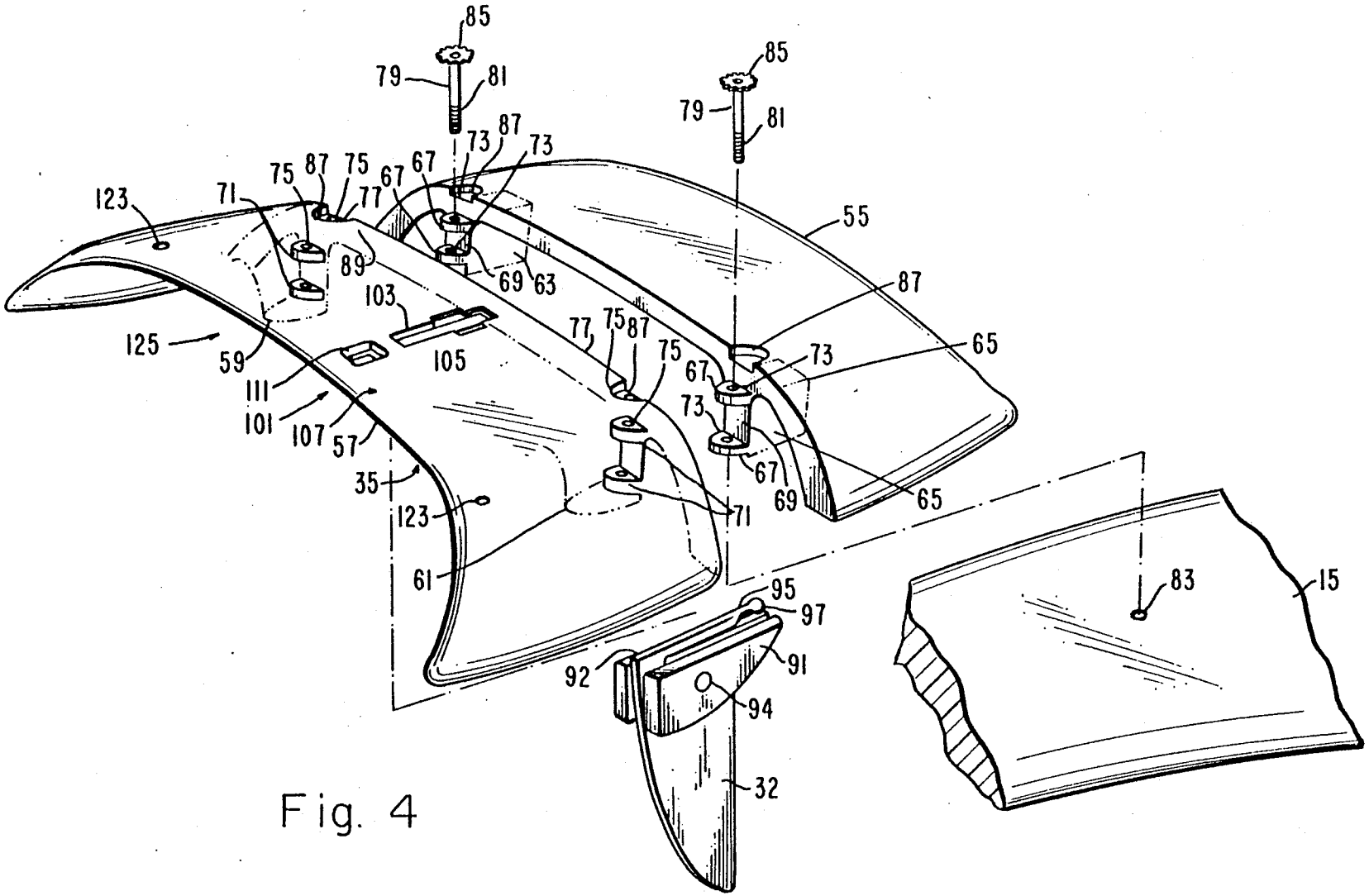
FIG. 4 is a front top right exploded and perspective view of the platform of the the sailing vessel of the present invention, including a collapsible centerboard with portions of the platform shown in phantom lines normally not visible, and a partial view of a board is also shown.

The platform 17 as shown in FIGS. 1, 3, and 4 has a rear section 55 and a front section 57. As can be seen more clearly in FIG. 4, the front section 57 and the rear section 55 can dissociate in an unassembled condition for ease of transportation and storage. The front section 57 and the rear section 55 can be easily reassembled and installed upon the first board 13 and the second board 15 for purposes of sailing the vessel 11. The front section 57 of the platform 17 has lower legs 59 and 61 partially shown in phantom lines and descending from the undersurface 35 of the platform 17. Similarly, the rear section 55 has aligning descending legs 63 and 65. The legs 59, 61, 63 and 65 extend a vertical length so as to engage the first board 13 and second board 15, respectively. The length of the legs 59, 61, 63, and 65 is uniform. The longitudinal length of the legs 59, 61, 63, and 65 may fully extend along the length of the front section 57 and the rear section 55, respectively; however, in the preferred embodiment the legs extend only a quarter of the longitudinal length of the front section 57 and the rear section 55, respectively. The width of the legs 59, 61, 63, and 65 are sufficient so as to support the platform 17 in an assembled condition while engaging the first board 13 and the second board 15, respectively. This unique arrangement provides for a two-point balanced engagement between each of the two boards 13 and 15, respectively, and the platform 17.

Projecting semi-circular extending tabs 67 may extend from a front forward lateral surface 69 of the legs 63 and 65 of the rear section 55 of the platform 17. In the preferred embodiment four such extending tabs 67 are shown. These extending tabs 67 are insertable within semi-circular slots 71 of the extending legs 59 and 61 of the front section 57 of the platform 17. The slots 71 may have an interior area so as to complement and engage the extending tabs 67 of the legs 63 and 65. Furthermore, the extending tabs 67 have vertically positioned bores 73 centered therethrough. Also, similar complementary bores 75 are vertically located through a rear edge 77 of the front section 57 of the platform 17 and pass through the semi-circular slots 71. Therefore, when the front section 57 and the rear section 55 are pushed into a assembled position, the bores 73 and 75 can be aligned vertically to allow pins or fastenings screw 79 to be pushed through said bores 73 and 75, respectively.

The fastening screws 79 may have threaded ends 81 which may engage threaded taps 83 correspondingly positioned within the first board 13 and second board 15, respectively. The threaded taps 83 provide receiving points for the threaded ends 81 of the fastening screws 79 to securely retain both the front section 57 and the rear section 55 of the platform 17 to the first board 13 and the second board 15, respectively. The threaded taps 83 are sufficiently secured within the interior of the first board 13 and second board 15, respectively so as not to pull free under the expected stresses and strains of sailing the vessel 11 in rough water with high waves or in high wind conditions. Alternatively, more than one fastening screw 79 can be used along the length of each of the legs 59, 61, 63, and 65 of the platform 17 provided additional complementing bores (not shown) and threaded taps (not shown) are provided through the platform 17 and in the boards 13 and 15, respectively. However, in the preferred embodiment only two fastening screws 79 are utilized to retain the platform 17 to the first board 13 and the second board 15, respectively. A number of different threaded taps 83 variably positioned along the width of the boards 13 and 1 allow adjustability to provide varied sailing performance by varying the angle of the boards 13 and 15 with respect to the platform 17.

As shown in FIG. 4, the fastening screws 79 may have star-shaped heads 85 to allow easier rotation of the fastening screws 79. Also, recessed portions 87 of the front section 57 and rear section 55 of the platform 17 can accommodate the star-shaped heads 85 to recess below a top surface 89 of the platform 17 when in a fully assembled condition. This prevents the star-shaped heads 85 of the fastening screws 79 from creating a safety problem. Also, the star-shaped heads 85 may be covered with a plastic material so as not to present any sharp edges which could inflict injury when scrambling upon the top surface 89 of the platform 17 barefooted.

The centerboard 32 is pivotedly mounted within a sheath 91 and a pivot pin 94 retains the centerboard 32 within the sheath 91 and is retained thereby. An upper portion 92 of the centerboard 32 has an extending armature 95 which can be manually pushed downward or lifted upward so as to retract or lower the centerboard 32, respectively. A knobbed end 97 of the armature 95 is engagable with the front section 57 of the platform 17 to securely retain the centerboard 32 in a descended position. The sheath 91 including the centerboard 32 may be screwedly fastened to a centrally located undersurface 101 of the front section 57 of the platform 17.

Brackets, bolts or an industrial adhesive (not shown) can be used to secure the sheath 91, including the centerboard 32 to the front section 57 of the platform 17. Directly above the centrally located undersurface 101 is a slot 103 through the front section 57 of the platform 17 allowing the armature 95 of the centerboard 32 to extend up through the front section 57 of the platform 17. The slot 103 has is a shape and enlarged size so as to complement the armature 95, especially the knob end 97 of the armature 95. When in an installed condition, the sailor or operator of the vessel 11 can depressed the armature 95 into the complementary slot 103 providing frictional engagement therebetween and holding the centerboard 32 within the sheath 91 in a downward position. Edges 105 of the slot 103 can be recessed or chamfered to allow the sailor to firmly grasp the armature 85 and exert sufficient upward force to disengage the armature 95 from the edges 105 of the slot 103 of the front section 57 of the platform 17. This upward force allows the centerboard 32 to pivot about the pivot pin 94 and retract the centerboard 32 which is necessary in shallow water or for transportation and storage.

Also, centrally located on a top surface 107 of the front section 57 is a recessed region 111 for associated hardware (not shown) for engaging a bottom end 113 of the mast 21 of the sail 19. The recess 111 and associated hardware, as well as the design of the bottom end 113 of the mast 21 are of a conventional type normally used with windsurfing-type devices well known in the art. Normally, such devices include a ball-and-socket configuration so as to allow the mast 11 to rotate in a number of different planes for providing steering capability and maximizing the force of wind to propel the vessel 11 depending upon wind direction , As shown in FIG. 1, strips 117 of Neoprene or like material can be used on the top surface 89 of the platform 17 to increase the coefficient of friction between the sailor's feet and the platform 17 to prevent slipping when operating the vessel 11.

The platform 17 arches between the first board 13 and the second board 15 and can be made of a fiberglass material having an internal flotational core. The material can be the same type of material as commonly used in the art of surfboards and windsurfing, sufficiently durable to prevent cracking, and yet completely flotational.

It should be noted that the platform 17 can be fastened to various points along each of the boards 13 and 15, respectively. In FIG. 4, a single screw tap 83 is shown. Any number of screw taps 83 can be incorporated to allow adjustability in locating the platform 17 between the first board 13 and second board 15. This adjustability allows the possibility of a slight inclination of the first board 13 and the second board 15 with respect to the surface of the water when sailing and provides a hydroplaning contact with the surface of the water.

A cut-out portion 119 along sides 121 of the platform 17 allow the free flow of water on either side of the sides 121 during sailing. This prevents the possibility of water build up between the platform 17 and the boards 13 and 17, respectively. Also, it should be noted that the platform 17 sufficiently arches above the first board 13 and second board 15 so as to provide a distance of at least six inches above the boards 15 and 17. This configuration reduces the possibility of the platform 17 hitting waves over the course of sailing the vessel 11 in rough water.

Figure 6:
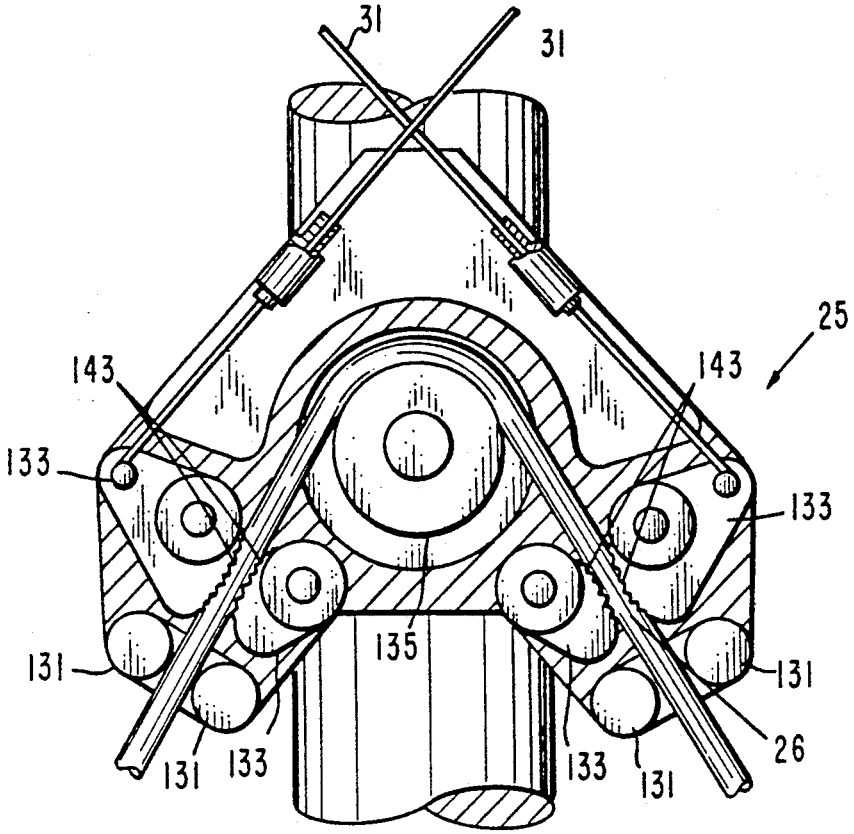
FIG. 6 is a front cross-sectional view taken midway through the mast stay means of the sailing vessel of the present invention shown in FIG. 5.
Figure 7:
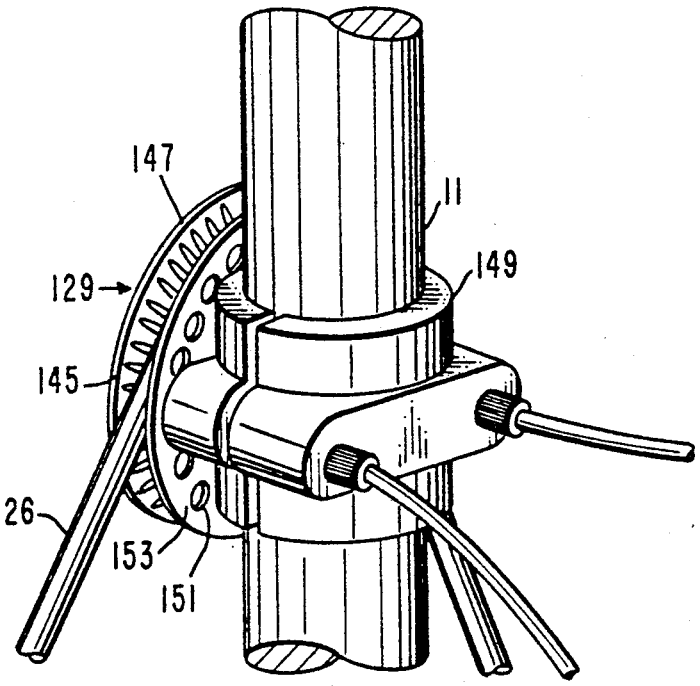
FIG. 7 is a rear top right perspective view of a second embodiment of a mast stay means of the sailing vessel of the present invention.

The platform 17 includes cable holes 123 through the front section 57 of the platform 17. Also, a groove 125 on the undersurface 101 of the front section of the platform connects the cable holes 123. The cable 26 of the mast retaining means 25 passes through the holes 123 and is held within the groove 125 when in an assembled condition. The mast retaining means 25 is movably attached to the boom 23 or the mast 21 and releasably secures the cable 26. The cable 26 is endless and is releasably held by the mast retaining means 25 as shown in FIGS. 1 and 6. Alternatively, a second mast retaining means 129 as shown in FIG. 7 can be incorporated to retain the mast in a desirable condition by retaining the second mast retaining means 129 in a particular location along the cable 26.

Figure 8:
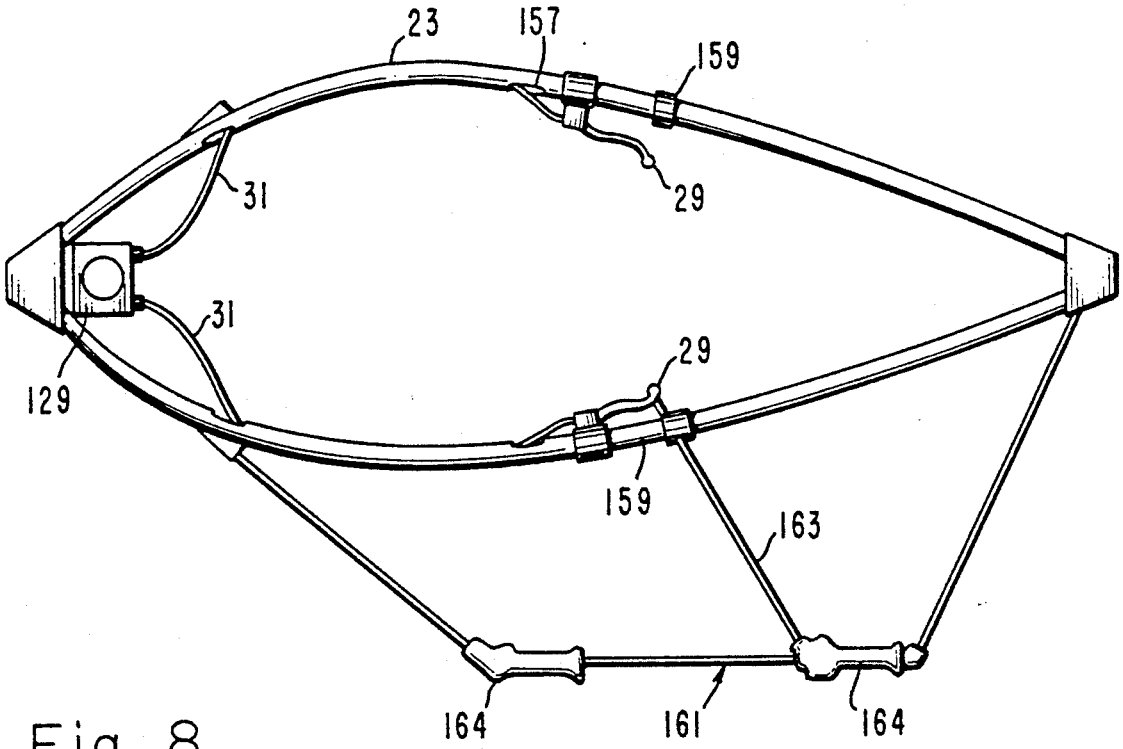
FIG. 8 is a top plan view of a sail boom including a mast stay means as shown in FIG. 7 of the sailing vessel of the present invention.

As shown in FIG. 6, the mast retaining means 25 has a series of rope guides 131, jam cleats 133 and a shive 135 retained within a housing 137 which is fastened to the mast 21 approximately three to five feet above the bottom end 113 of the mast 21. A ball-and-socket linkage (not shown) allows the housing 137 to rock sideways, as well as forward and backward. The cables 31 engage the jam cleats 133 so as to either engage or disengage the cable 26. As shown in FIGS. 1 and 8, the cables 31 can be actuated by the release levers 29 which are retained or fastened to the boom 23. By depressing one of the release levers 29, tension is placed on one of the cables 31 which pulls and releases the respective jam cleats 133 to allow the mast 21 to be moved with respect to the cable 26. When one of the release levers 29 is released, the respective jam cleats 133 engage the cable 26 at the present position along the length of the cable 26. The orientation of teeth 143 on the jam cleats 133 allow the cable 26 to be pulled in one direction relative to the orientation of the teeth 143.

In an alternate embodiment, a second mast stay means 129 incorporates a circular wheel 145 which has a retaining circumference or groove 147 which engages the cable 26. The second mast stay means 129 is clampedly mounted to the mast 11 using a bracket 149. The wheel 145 frictionally engages the cable 26 only allowing the mast 11 to move with respect to the cable 26 when the wheel 145 is able to rotate. The wheel 145 is only allowed to rotate when engagable pins (not shown) retract from at least one of a plurality of recesses 151 in an aft surface 153 of the wheel 145. The engaging pin or pins are actuating by the cables 31 which are actuated by release levers 29 fastened to the boom 23. As shown in FIG. 8, the cables 31 can alternatively be positioned through a hollow core 157 of the boom 23.

Also, hand grips 159 of a foam material may be positioned adjacent to the release levers 29 for a more secure grip. Again, release levers 29 and cables 31 may be positioned on both sides of the boom 23. Furthermore, in this embodiment of the second mast retaining means 129, an extended boom 161 may be used so as to allow the sailor to extend out away from the sail 19 yet retain control thereof. The extended boom 161 also includes a cable 163 associated with one of the release levers 29 so as to actuate the second mast retaining means 129 and move the sail 19 from a fixed position. As shown in FIG. 8, additional hand grips 164 can be utilized to engage the extended boom 161. It should be noted that the second mast retaining means 129 is clampedly held in conjunction with the mast 21 of the sail 19.

Because of the unique mast retaining means 26 shown in FIG. 1 and FIG. 6 and the second mast retaining means as shown in FIGS. 7 and 8, a much larger sail 19 can be used because the sailor is offered some assistance in retaining the sail 19 in a fixed position. Therefore, the larger sail 19 can allow greater speed of the vessel 11. As shown in FIG. 1, sail struts 171 can be used to extend the sail outward so as to catch a greater amount of wind and propel the craft even faster. The mast retaining means 25, the second mast retaining means 129, the cables 31, the cable 26 and the release levers 29 should be made of a material which is lightweight and will not corrode with exposure to salt water.

Much of the technology and features of the wind sailing and windsurfing art can be incorporated in addition to those features described in more detail above. It should be appreciated from the foregoing description that the present invention provides an improved sailing vessel which is completely portable, and versatile in that an inexperienced sailor can attain extreme maneuverability and speed not known to comparable craft in the art. The sailing vessel of the present invention provides for a greatly stabilized "windsurfing-type" craft having a greater ease of operation and turning ability, yet requires little balance, coordination and muscular agility. Furthermore, the sailing vessel of the present invention is completely versatile for sailing in an assembled condition or dissociated and used as a conventional windsurfing craft. The vessel is compact and completely portable for purposes of transportation and storage. The sailing vessel is easy to assemble as well as disassemble and easy to manufacture. It should be noted that the unique configuration of the undersurfaces 38 and 41 of the boards 13 and 15, respectively in conjunction with the descending centerboard 32 provide a great deal of turning capability in a relatively short distance.

Conventional sailing vessels with two hulls or having standard bows or pontoons have not been able to achieve the same capability as the instant invention. However, the boards 13 and 15 skim over the surface of the water and can actually pivot about the centerboard 32, providing an ease of turning heretofore unknown in the art of catamaran sailing. Yet, the centerboard 32 in combination with the rear fins 43 of the board 13 and 15 provide a completely stable vessel which can hold a desired course in high wind and rough water.

Although the present invention has been described in detail in reference only to present-preferred embodiment, it will be appreciated by those of ordinarily skilled in the art that various modifications can be made without departing from the invention. Accordingly, the invention is limited only by the following claims.

I claim:

1. A wind sailing vessel for sailing over a water surface comprising:

(a) a first elongated board defining an undersurface substantially planar, said first elongated board being buoyant in water;

(b) a second elongated board defining an undersurface substantially planar, said second elongated board being buoyant in water;

(c) platform means for joining said first and second elongated boards in parallel relationship, wherein said platform means is dissociable from each of said elongated boards and each of said elongated boards having slots for receiving a centerboard means, wherein said platform means defines a slot parallel to said elongated boards in an assembled condition and sized to allow a portion of said centerboard means to extend therethrough, whereby said centerboard means can be retracted or extended through said slot and retained therein during sailing, and wherein said platform means comprising independent sections which can be selectively dissociated from each other, wherein said platform means can be collapsed for ease of transportation or storage;

(d) centerboard means for providing sailing maneuverability operatively associated with said platform means, wherein said centerboard means is parallel to said elongated boards and provides substantial steerability yet remains fixed and rigid while sailing, wherein said planar undersurfaces of said elongated boards skim over the water surface and said elongated boards pivot about a point defined by said centerboard means upon turning the vessel; and (e) sail means for catching gusts of wind and propelling the vessel, wherein said sail means is pivotally mounted on said platform means, and wherein said platform means provides a centrally located mounting for said sail means.

2. A wind sailing vessel as claimed in claim 1, wherein said platform means has an arch shape, allowing said platform means to arch between said elongated boards and provided a predetermined clearance height between water surface and an underside of said platform means when the vessel is in an assembled condition and placed upon the water surface.

3. A wind sailing vessel as claimed in claim 2, further comprising fastening means for fastening said platform means to said elongated boards, said fastening means being releasable so as to allow selective dissociation of said platform means from said boards, and wherein said fastening means selectively locks said independent sections of said platform means together.

4. A wind sailing vessel as claimed in claim 3, said sail means comprising a grippable boom means for holding and orienting said sail means, wherein said sail means is of a large size having an erected height greater than the length of one of said elongated boards.

5. A sailing vessel as claimed in claim 4, each of said undersurfaces of said elongated boards including rearwardly positioned fins means for providing stabilization, and wherein said undersurfaces of said boards curve upwardly at their bow ends sufficient to allow said boards to controllably skim over water surface in a linear direction and pivot about a point defined by said centerboard means for turning.

6. A sailing vessel as claimed in claim 5, wherein said planar undersurfaces of said elongated boards are at least one foot in width, and wherein said undersurfaces curve upwardly along said bow ends of said elongated boards by an amount between 15° to 30° from a plane defined by said undersurfaces.

7. A sailing vessel as claimed in claim 6, wherein said platform means includes extending vertical legs which selectively and modularly attach or detach from said elongated boards and can selectively engage said boards at various points along the width of said boards.

8. A sailing vessel as claimed in claim 7, wherein said platform means has a predetermined clearance height of at least six inches between said undersurfaces of said elongated boards and said underside of said platform means when in an assembled condition.

9. A sailing vessel as claimed in claim 8, comprising an adjustable mast stay means for retaining said sail means in a predetermined position against gusts of wind, said mast stay means operatively associated with said sail means and extending a distance away therefrom and fastenable to said platform means, and exerting tension between said sail means and said platform means, said mast stay means being quickly releasable from a set position.

10. An aquatic craft comprising:

a first flotational body and a second flotational body having planar surfaces, each having an elongated shape, each having stern and bow ends, wherein said planar surfaces of said bow end curve upwardly, said first and second flotational bodies being parallel and joined together by an overlying deck means for connecting said first and second flotational bodies together and providing standing room to operate the craft, wherein said deck means extends a predetermined degree above said planar surfaces and includes a daggerboard centrally located thereunder and descending below said deck means, said daggerboard positioned parallel to said first and second flotational bodies and perpendicular to said planar surfaces, wherein a portion of said daggerboard descends below said planar surfaces, allowing said craft to turn by pivoting said flotational bodies about a point defined by said daggerboard, wherein said deck means can be operatively dissociated with said first and second flotational bodies, and wherein each of said first and second flotational bodies include associated fittings and recesses to engage said daggerboard and a windsurfing sail, wherein said deck means includes a connecting means for connecting said windsurfing sail to said deck means allowing said windsurfing sail to pivotally rotate about a centrally located point, yet retain said windsurfing sail to said deck means, and wherein said deck means associatively engages said flotational bodies at a number of predetermined points along a curved upper surface along a width of each of said first and second flotational bodies, thereby allowing variability of an angle between said planar surfaces and said daggerboard, and wherein said planar surfaces upwardly curve at the periphery of said planar surfaces.

11. An aquatic craft as claimed in claim 10, said deck means further comprising a plurality of space-apart adjustable legs to change the angle between said planar surfaces of said first and second flotational bodies and said daggerboard.

12. A surf-sailing craft comprising:

(a) a first specially adapted windsurfing board having a first undersurface;

(b) a second specially adapted windsurfing board having a second undersurface;

(c) a wind surfing sail assembly comprising a boom, sail and mast in conventional association, and wherein said sail is oversized;

(d) a centerboard parallel to and in between said first and second windsurfing boards and downwardly projecting through a horizontal plane defined by said first and second undersurfaces; and (e) an upraised platform engagably disengageable to said first and second wind surfing boards forming an arch therebetween and fastening said boards in a spaced, side-by-side relationship in an assembled condition, said platform operatively engaging said centerboard which may be extended in an assembled condition for providing sailing stability, said platform further including a fastening means for fastening a bottom end of said windsurfing sail assembly to a center area of said platform and allowing said windsurfing sail assembly to pivot about said bottom end, wherein said platform can be disengaged from said first and second wind surfing boards each of which can be independently sailed, and wherein said platform includes a plurality of spaced-apart adjustable feet which can engage said boards at a predetermined inclination, and said platform is modularly constructed of at least two sections which can be dissociated for compactness, and further comprising a sail stay means operatively associated with said platform to selectively and releasably maintain said windsurfing assembly in a desired position.

13. A surf-sailing craft as claimed in claim 12, wherein said windsurfing boards have planar undersurfaces and can pivot about a point defined by said centerboard for turning said craft and wherein said sail stay means can be activated along said boom of said windsurfing sail assembly.

* * * * *